US006757931B2

(12) United States Patent
Nordstrom

(10) Patent No.: US 6,757,931 B2
(45) Date of Patent: Jul. 6, 2004

(54) PAINTBRUSH HOLDER

(76) Inventor: Brian Nordstrom, Box 414, Battle Lake, MN (US) 56515

( * ) Notice: Subject to any disclaimer, the term of this patent is extended or adjusted under 35 U.S.C. 154(b) by 112 days.

(21) Appl. No.: 10/055,326

(22) Filed: Jan. 22, 2002

(65) Prior Publication Data

US 2003/0135945 A1 Jul. 24, 2003

(51) Int. Cl.[7] ..... A46B 17/00
(52) U.S. Cl. ..... 15/248.1; 15/184; 206/361
(58) Field of Search ..... 15/168, 18, 248.1; 206/15.3, 204, 361, 362.3, 362.4; 150/161

(56) References Cited

U.S. PATENT DOCUMENTS 512,363 A * 1/1894 Clarke ..... 15/248.1
1,161,378 A * 11/1915 Day ..... 15/248.1
1,199,837 A * 10/1916 Thompson ..... 15/248.1
1,455,656 A * 5/1923 Phillips et al. ..... 15/248.1
2,485,068 A * 10/1949 Santana ..... 206/361
2,892,205 A * 6/1959 Wagner ..... 15/248.1
3,061,864 A * 11/1962 Miller ..... 15/248.1
4,299,006 A * 11/1981 Cruz ..... 15/248.1

FOREIGN PATENT DOCUMENTS

GB 581267 * 10/1946 ..... 15/248.1

* cited by examiner

*Primary Examiner*—Mark Spisich
(74) *Attorney, Agent, or Firm*—Moore, Hansen & Sumner

(57) ABSTRACT

A protective holder for use with a paintbrush. The holder has a flexible sleeve that is configured to be snuggly positioned about a substantial portion of a paintbrush body. The sleeve has an aperture through which the handle of a brush may extend, and may also include absorbent material that captures liquid that dribbles down from the applicator portion of a paintbrush when the paintbrush is held vertically. The holder also has a protective, segmented skirt that is operatively connected to the sleeve and whose segments or panels may be selectively moved between a protective storage position where the skirt substantially encircles the applicator portion of a brush, and a protective use position where the skirt substantially encircles the handle of a brush. The holder also may have a fastener to maintain the skirt in either of its protective positions.

18 Claims, 2 Drawing Sheets

PAINTBRUSH HOLDER

BACKGROUND OF THE INVENTION

This invention relates generally to accessories for brushes. More particularly, this invention pertains to an apparatus that is configured and arranged to protect the applicator end of a brush when the brush is not being used, and which protects the handle portion of a brush when the brush is being used.

Accessories for brushes and in particular paintbrushes have been around for some time. Usually, they pertain to one of two common problems. One, the problem of liquid dribbling onto a person's hand and arm when a charged brush is held vertically. And two, the problem of storing a brush after use. Attempts to solve the dribbling problem has lead to the development of drip cups and collars, exemplified by U.S. Pat. No. 1,161,378 issued to Day, Nov. 23, 1915; U.S. Pat. No. 4,299,006, issued to Cruz, Nov. 10, 1981; and U.S. Pat. No. 5,084,932, issued to Zanchi, Feb. 4, 1992. These devices generally have the common features of being able to encircle the ferrule of a paint brush in a sealing manner, and include the provision of a reservoir or chamber that collects paint which would otherwise dribble onto the hand and arm of a user. These devices are not without their drawbacks. In order to be able to prevent liquid from running down upon a user, they need to be kept in a vertical orientation. Otherwise, if a person needed to take a break and were to set the brush onto a horizontal surface, for example, the contents of the chamber would flow out of the chamber and onto the surface to create a mess. Another drawback is that the aforementioned devices do not appreciably protect the bristles from becoming soiled or from applying paint in an undesired location. Thus, even if the chambers of these devices were not filled with paint and a person needed to take a break from painting, the person would still have to be careful where to set the brush down. Most often, this takes the form of balancing the brush precariously on a support such as a paint can. Alternatively, the person could place the brush on a sacrificial surface such as a rag or newspaper.

Attempts to solve the storage problem has lead to the development of storage bags and keepers, exemplified by U.S. Pat. No. 5,174,445, issued to Mull, Dec. 29, 1992; U.S. Pat. No. 5,244,090, issued to Keith, Sep. 14, 1993; and U.S. Pat. No. 5,709,301, issued to Couch et al., Jan. 20, 1998. These devices share a common characteristic in that they protect the bristles of a brush when the brush is not being used to apply paint to a surface. This may be accomplished in a number of ways, such as placing the brush into a bag, or a protective shell. A drawback with these aforementioned devices is that if a user stores a brush and later decides to do some additional touch-up work, the user must completely disengage the brush from the holder. Another drawback is that these devices are not intended to be used when the paintbrush is positioned with its bristles pointing up. If a user were to do so, paint or other liquids on the brush would dribble down past the body and down the handle to create a mess.

There is a need for an apparatus that is able to protect the applicator portion of a paintbrush when the brush is not in use. There is also a need for an apparatus that is able to prevent liquids from dribbling down the handle portion of a paintbrush and onto a person's hand and arm when the brush is being held in a generally vertical orientation. There is also a need for an apparatus that is able to capture liquid that dribbles down past the applicator portion of a brush when in use, and later able to disgorge the liquid in a cleaning operation. There is also a need for an apparatus that may be easily and quickly converted between a plurality of protective positions. And there is also a need for a protective apparatus that may be operatively attached to a paintbrush.

SUMMARY OF THE INVENTION

The present invention is a protective brush holder that is capable of performing two separate, though related functions. The first function is to protect a users hand while a paintbrush is being held and used in a substantially vertical orientation. The second function is to protect the applicator portion of a paintbrush when the paintbrush is not being used. The multi-functional, protective brush holder comprises a sleeve that is operatively connected to a skirt. The sleeve is configured and arranged to substantially encircle the body of a paintbrush in a nesting relation. The sleeve comprises a base and a plurality of side walls that are arranged to form a cavity into which the body of a paintbrush may be positioned. The base includes an aperture to allow of a handle of a brush to extend therethrough so that the handle may be gripped in a normal fashion.

The skirt of the brush holder comprises a pair of opposing panels that are operatively connected at the edges of the sleeve cavity by integrally formed hinges. The panels are sized so that when the brush holder is in its user protecting position, they extend towards the handle of the brush and protect a user's hand. And, when the brush holder is in its brush protecting position, the panels substantially cover the applicator portion of a paintbrush.

Each of the panels of the skirt includes opposing extensions that are operatively connected thereto along transverse edges by integrally formed hinges. In use, the extensions enable the skirt to be configured into a protective enclosure when the brush holder is in its protective positions. Preferably, the extensions are somewhat trapezoid and taper with respect to the integrally formed hinges. This allows the protective skirt enclosure to be drawn up against the applicator portion of a brush to prevent splaying and to help the applicator maintain its original form. The extensions may be fastened to each other by a single fastener, or a fastener that comprises complimentary fastening elements, for example, hook and loop fasteners. Alternatively, the extensions may be provided with integrally formed slots and tabs that allow the skirt to be formed into a protective enclosure. Or, the skirt may be retained in a protective enclosure by cord, elastic bands, tape, staples, paper clips, or other known fasteners. While the extensions enable the skirt enclosure to be configured into the somewhat rectangular shape of the applicator portion of a brush, it will be appreciated that they are not necessary to practice the invention. That is, the panels may be sufficiently sized to that they attach to each other directly and form a lens-shaped protective enclosure. It will also be appreciated that the skirt may be sized so that it may completely enclose the applicator portion of a brush, or sized so that it partially covers the applicator portion of a brush. It is also envisioned that the panels may be different sizes to differentially cover the applicator portion of a brush. The brush holder is made of material that resists absorption. This may include materials such as Styrofoam or cardboard with a protective layer of non-absorbent material thereon. However, material such as polystyrene is preferred because it is flexible and is amenable to mass production techniques.

The brush holder may also include an inner liner that is configured and arranged to substantially fit into the sleeve cavity so that it is adjacent the body of a brush. As with the sleeve, the inner liner comprises a base and a plurality of side walls that are arranged to form a cavity into which the body of a paintbrush may be positioned. The inner liner base also includes an aperture to allow of a handle of a brush to extend therethrough so that the handle may be gripped in a normal fashion. The inner liner comprises absorbent material that is capable of capturing and retaining liquid that dribbles down a brush that is being used and held in a generally vertical orientation. The material may be natural or manmade, however, sponge rubber is preferred. The opposing surfaces base of the inner liner may be provided with low-tack adhesive so that the inner liner operatively connects the brush holder to a paintbrush. This would also enable the liner to be disposed of when necessary or desired, and replaced with a new liner.

Sometimes, brushes have removable handles that are connectable to the body of a brush. These connections may comprise complimentary shaped threads, with the handle having the male end and the body having the female end. The male end of the connection is usually provided with a shoulder that limits the depth to which the insertion may be made. With these types of brushes, it is envisioned that the holder may be operatively connected thereto in an alternative manner. That is, the aperture in the sleeve may be configured to be smaller than the shoulder of the handle and large enough to allow passage of the male end of the handle therethrough. This would permit the paintbrush holder to be operatively connected to a brush by removing the handle, positioning the holder about the body of the brush, and then attaching the handle to the brush and seating it against the body. As the handle is seated, a portion of the holder is securely pinched between the shoulder of the handle and the body of the brush.

An object of the preferred invention is to provide a multi-functional brush holder that is able to be configured into predetermined, protective positions.

Another object of the present invention to provide a brush holder that is able to effectively retain liquid that dribbles down from the applicator end of the brush when the brush is held in a vertical orientation and protect a user's hand from becoming soiled.

Yet another object of the present invention is to provide a brush holder that is able to protect the applicator portion of a brush when the brush is not being used.

A feature of the present invention is that liquid that dribbles down towards a handle is captured within a sleeve that substantially encircles the body of a paintbrush in a sealing relation.

Another feature of the invention is that a portion of the sleeve is provided with absorbent material that effectively captures and retains liquids.

Another feature of the present invention is the provision of an inner liner that is positioned substantially within the sleeve in a nesting relation.

Another feature of the present invention is the provision of a manipuable skirt that is operatively connected to the sleeve of the apparatus.

Yet another feature of the present invention is that the skirt comprises a plurality of panels and extensions that are operatively connected to each other and which may be formed into protective enclosures.

Still another feature of the invention is that the extensions of the skirt include fastening elements that facilitate formation of the skirt into the protective enclosures.

Yet another feature of the present invention is that the skirt prevents splaying and assists in maintaining the shape of an applicator when is positioned about the applicator.

An advantage of the present invention is that it takes substantially less time to clean up and proceed to the next job.

Another advantage of the invention is that the life of a brush is extended.

These and other objects, features and advantages of the present invention will become apparent from the following detailed description thereof taken in conjunction with the accompanying drawing, wherein like reference numerals designate like elements throughout the several views.

DESCRIPTION OF THE PREFERRED EMBODIMENT

Figure 1:
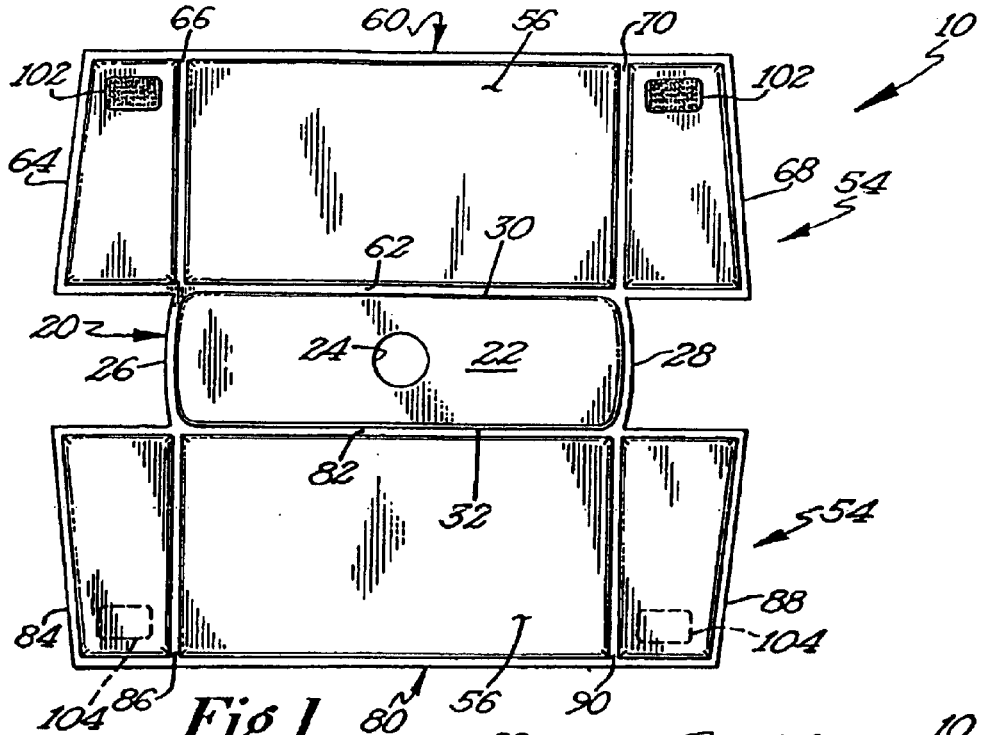
FIG. 1 is a plan view of a preferred embodiment of the invention illustrating a first surface of the components that form a sleeve and a selectively positionable skirt.

Referring to FIG. 1, the brush holder 10 of the present invention generally comprises two main components, a sleeve 20 and a selectively positionable skirt 54. More particularly, the sleeve 20 is configured to substantially encircle the body of a brush in a nesting relation. This is achieved by providing the sleeve 20 with a base 22 and a plurality of sidewalls 26, 28, 30, 32 and arranging the base and sidewalls so that they may contact the brush body. In order to facilitate attachment of the holder to a brush, the base 22 is provided with an aperture 24 through which the handle of a brush may extend.

The skirt 54 comprises a first panel 60 having extensions 64, 68, and a second panel 80 having extensions 84, 88. The first and second panels 60, 80 are operatively connected to the sleeve 20 by hinges 62, 82, respectively. The hinges 62, 82 comprise portions of thinned material in the nature of live hinges that allow manipulation of the panels 60, 80 relative to the sleeve 20. Preferably, the hinges 62, 82 are formed along with the sleeve 20 and the panels 60, 80 to facilitate manufacture. It is understood, however, that other operative connections are possible.

Skirt 54 extensions 64, 68 are in longitudinal alignment with panel 60, and are operatively connected thereto by hinges 66, 70, respectively. As with the hinges 62, 82, these hinges also comprise portions of thinned material and are formed along with the sleeve 20 and the panels 60, 80. As can be seen, the extensions 64, 68 are slightly trapezoidal in shape with the outermost edge being skewed relative to hinges 66 and 70, respectively. The reasons for such a configuration will be discussed in greater detail below.

Likewise, panel 80 includes extensions 84, 88 that are in longitudinal alignment therewith, and which are operatively connected thereto by hinges 86, 90, respectively. As with the hinges 62, 82, these hinges also comprise portions of thinned material and are formed along with the sleeve 20 and the panels 60, 80. As can be seen, the extensions 84, 88 are slightly trapezoidal in shape with the outermost edge being skewed relative to hinges 86 and 90, respectively.

Figure 2:
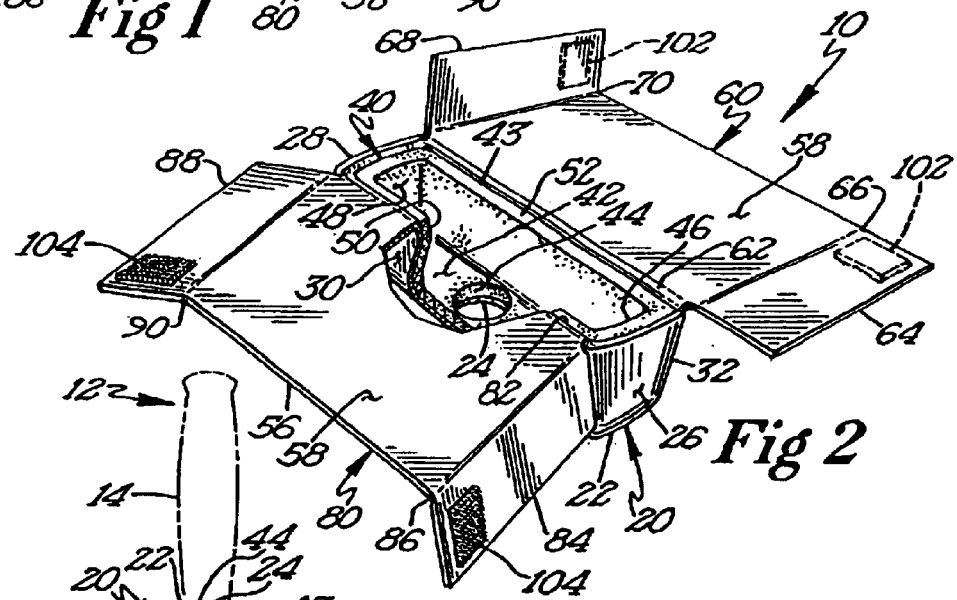
FIG. 2 is a perspective view of the embodiment of FIG. 1 illustrating a second surface of the components that form a sleeve and a selectively positionable skirt.

Referring now to FIG. 2, the holder 10 is depicted prior to attachment to a paintbrush. As shown, the sleeve 20 may include an inner liner 40 that is configured and arranged to be positioned substantially with the sleeve 20 in a nesting relation. It will be appreciated that the inner liner 40 comprises a base 42 with an aperture 44 (see FIGS. 3, 4, and 5), and sidewalls 46, 48, 50, and 52 that correspond to the base, aperture, and sidewalls of the sleeve 20. The inner layer 40 comprises of material that is capable of absorbing and retaining liquids that may dribble down from an applicator of a paintbrush that is held in a vertical orientation. Preferably, the inner liner 40 comprises foam rubber, but it will be appreciated that other materials may be used. The Portions of the inner liner 40, and in particular the base 42, may be provided with a low tack adhesive 43 (see, FIG. 4) so that the inner liner 40 may be used to operatively attach the holder 10 to a brush 12. Alternatively, if the holder 10 is used without an inner liner 40, it is envisioned that the inner surfaces of the sleeve 20, and in particular the base 22, may be provided with a low tack adhesive to operatively connect the holder 10 directly to the body of a brush.

As mentioned above, the skirt 54 may be selectively positioned relative to the sleeve 20 by manipulating the panels 60, 80 at hinges 62, 82. More particularly, the skirt 54 is movable between a first position where it is substantially coextensive with the applicator of a brush and a first surface 56 is exposed, and a second position where it is substantially coextensive with the handle of a brush and a second surface 58 is exposed. In this depiction, the skirt 54 is intermediate the first and second positions and the second surface 58 is shown.

Figure 3:
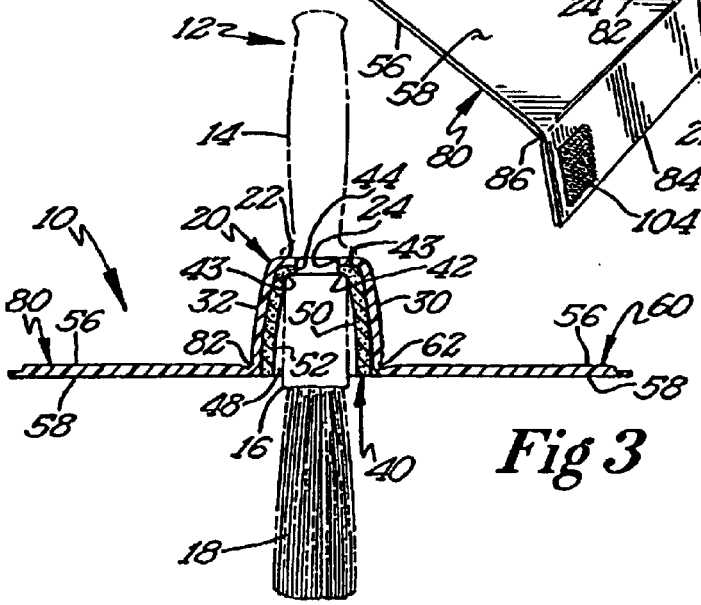
FIG. 3 is a cross-sectional view of a preferred embodiment illustrating the juxtaposition of a preferred embodiment of the invention and a brush shown in phantom.

Referring to FIG. 3, a paint brush 12 having a handle 14, a body 16 and an applicator 18 is depicted in dashed lines as it would be positioned relative to the sleeve 20 of a paintbrush holder 10. Note that the panels 60, 80 are in an intermediate position and may be manipulated towards the handle 14 or towards the applicator 18. Note also, that the first and second surfaces 56, 58 will be exposed when the skirt 54 is in its respective first or second position.

Figure 4:
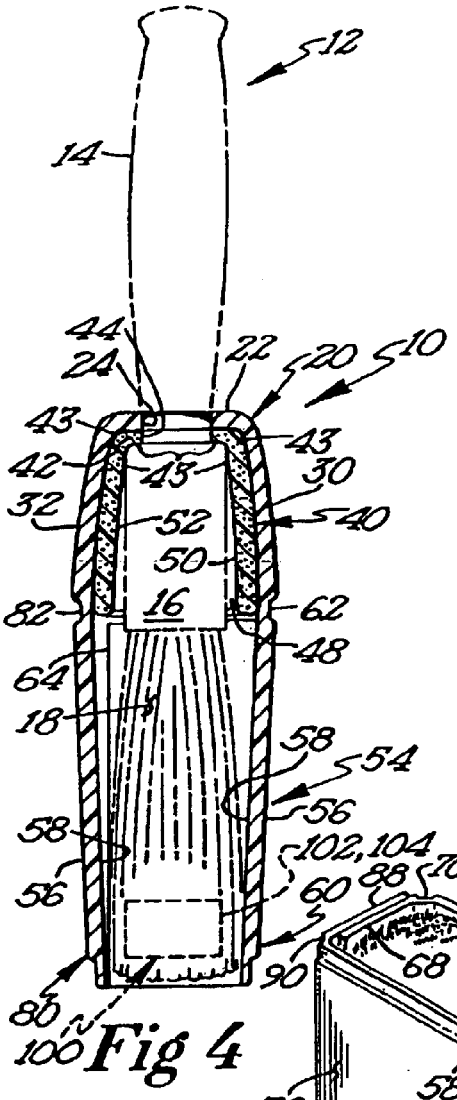
FIG. 4 is a cross-sectional view of FIG. 3 in which the skirt has been moved to a protective position in which the applicator of a brush is substantially covered.

Referring to FIG. 4, a paint brush 12 having a handle 14, a body 16, and an applicator 18 is depicted in dashed lines as it would be positioned relative to a paintbrush holder 10 in which the skirt 54 has been manipulated into its protective position where it is substantially coextensive with the applicator 18 of the brush 12 and forms a protective enclosure therefor. In this configuration, the first surface 56 of the skirt 54 forms the external surface of the protective enclosure while the second surface 58 of the skirt 54 forms the internal surface of the protective enclosure. As mentioned above, portions of the inner liner 40 may be provided with a low tack adhesive to operatively attach the liner 40 to the holder 10, and the holder 10 to a brush 12. As depicted, low tack adhesive 43 is provided on portions of the inner liner's interior and exterior surfaces, preferably adjacent the base 42 of the liner 40. It is understood, however, that the adhesive may be applied at other locations, if desired.

Figure 5:
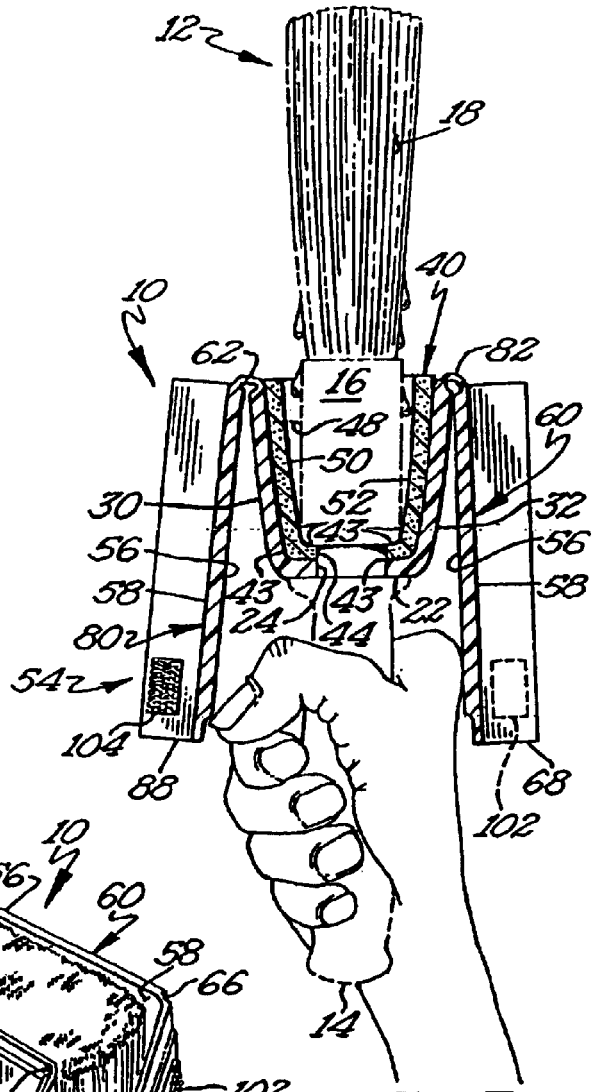
FIG. 5 is a cross-sectional view of FIG. 3 in which the skirt has been moved to a protective position in which the handle of a brush is substantially covered; and, FIG. 6 is a perspective view of FIG. 3 illustrating how the components of the skirt are positioned about the applicator of a brush.

Referring to FIG. 5, a paint brush 12 having a handle 14, a body 16, and an applicator 18 is depicted in dashed lines as it would be positioned relative to a paintbrush holder 10 in which the skirt 54 has been manipulated into its protective position where it is substantially coextensive with the handle 14 of a paintbrush 10 that is being grasped by a user. In this configuration, the first surface 56 of the skirt 54 now forms the internal surface of the protective enclosure, and the second surface 58 now forms the external surface of the protective enclosure. Note that the protective enclosure acts as a shield to protect a user from paint when the paintbrush is used in a generally vertical orientation. Although not shown, the extensions 64, 84, and 68, 88, of the panels 60, 80 may be operatively conned to each other by fastening elements 102, 104 to form a protective enclosure for a brush handle 14 and a user's hand.

Figure 6:
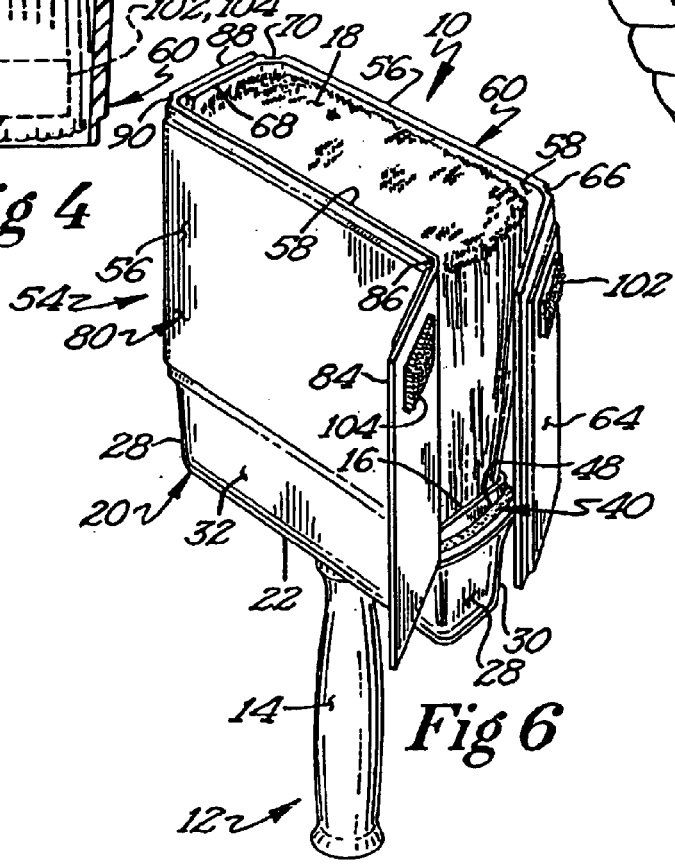

Referring now to FIG. 6, a paintbrush 12 is depicted in conjunction with the paintbrush holder 10 as it is being manipulated into its protective position where it is substantially coextensive with the applicator 18 of the paintbrush 12. As depicted, extensions 68, 88 of panels 60 and 80 have been folded about hinges 70 and 90, respectively, to form one end of a protective enclosure. Here, the extension 88 overlays extension 68. To complete the protective enclosure, extensions 64, 84 of panels 60, 80 are folded about hinges 70, 90 to form the other end of the protective enclosure. Note that surface 56 of extension 64 includes a fastening element 102, and surface 58 of extension 84 includes a fastening element 104, with the fastening elements 102, 104 configured and arranged to operatively connect the extensions 64, 84 together and complete the protective enclosure form. That is, the extension 84 will overlay the extension 64. Conversely, when the paintbrush holder 10 is in its second protective position, the positions of the extensions 64, 84 will be reversed so that extension 64 will overlay extension 84. As mentioned above, fastening elements such as hook and loop type fasteners may be used. However, it is understood that other fasteners such as tabs and slots, cords, staples, tape, clips, or elastic bands may be used.

Thus described, this invention provides a device that protects the bristles of a paint brush while in storage, and protects the handle of a paint brush while in use.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A holder for a paintbrush of the type having a handle, a body, and an applicator, the holder comprising:

a sleeve having a plurality of sidewalls and a base with an aperture;

a liner, the liner having a plurality of sidewalls and a base with an aperture, with the liner arranged and configured to fit into said sleeve in a nesting relation; and, a skirt, the skirt operatively connected to the sleeve and movable between a first position where the skirt is substantially coextensive with the applicator of a brush, and a second position where the skirt is substantially coextensive with the handle of a brush;

wherein the holder receives the body of a paintbrush in a nesting relation with the handle of the paintbrush protruding through the aligned apertures of the sleeve and the liner in a sealing relation;

whereby liquid that dribbles from a charged applicator towards a handle of a paintbrush when the paintbrush is held in an vertical orientation is captured by the inner liner of the holder and prevented from contacting the user of the brush.

2. The holder of claim 1, wherein said skirt comprises: a first panel and a second panel, with the first panel and second panel constructed and arranged to be operatively connected to each other when the skirt is moved into its first and second positions.

3. The holder of claim 2, wherein each of said first and second panels further comprise opposing extensions, with said opposing extensions of said first and second panels arranged and configured to contact each other in a substantially overlapping relation when the skirt is moved into its first and second positions.

4. The holder of claim 2, further comprising a fastener, the fastener operable to maintain said panels in a predetermined orientation when said skirt is moved into its first and its second positions.

5. A protective holder for a paintbrush of the type having a handle, a body, and an applicator, the protective holder comprising:

a flexible sleeve, the flexible sleeve having an inner surface comprising absorbent material and an outer surface comprising non-absorbent material; the flexible sleeve positionable about the body of a paintbrush so that said inner surface is adjacent to the applicator of a paintbrush, whereby the flexible sleeve collects liquid that dribbles from a charged applicator towards a handle of a paintbrush when the paintbrush is held in an vertical orientation; and, a skirt, the skirt operatively connected to the sleeve and movable between a first position where the skirt is substantially coextensive with the applicator of a brush, and a second position where the skirt is substantially coextensive with the handle of a brush.

6. A protective holder for a paintbrush of the type having a handle, a body, and an applicator, the protective holder comprising:

a flexible sleeve, the flexible sleeve having an inner surface and an outer surface; the flexible sleeve positionable about the body of a paintbrush so that said inner surface is adjacent to the applicator of a paintbrush, whereby the flexible sleeve collects liquid that dribbles from a charged applicator towards a handle of a paintbrush when the paintbrush is held in an vertical orientation; and, a skirt comprising a first panel and a second panel, with the first and second panels constructed and arranged to be operatively connected to each other when the skirt is moved into a first position where the skirt is substantially coextensive with the applicator of a paintbrush, and a second position where the skirt is substantially coextensive with the handle of a paintbrush.

7. The protective holder of claim 6, wherein each of said first and second panels further comprise opposing extensions, with said opposing extensions of said first and second panels arranged and configured to contact each other in a substantially overlapping relation when the skirt is moved into its first and second positions.

8. The protective holder of claim 6, further comprising a fastener, the fastener operable to maintain said panels in a predetermined orientation when said skirt is moved into its first and its second positions.

9. A protective holder in combination with a paintbrush having a removable handle having an attachment end with a shoulder, a body having a handle receiving aperture, and an applicator, the protective holder comprising:

a sleeve comprising a plurality of sidewalls and a base with an aperture;

wherein the sleeve of the protective holder is configured to substantially receive the body of the paintbrush in a nesting relation such that the aperture of the sleeve is in substantial alignment with the handle receiving aperture of the paintbrush body; and, wherein the protective holder is retained on the paintbrush between the shoulder of the handle and the body of the a paintbrush as the attachment end of the handle is inserted into the handle receiving aperture of the body of the paintbrush that has been substantially received within the sleeve.

10. The combination of claim 9, further comprising a liner having a plurality of sidewalls and a base with an aperture, with the liner arranged and configured to fit into said sleeve in a nesting relation;

wherein the liner of the protective holder is configured to substantially receive the body of the paintbrush in a nesting relation such that the aperture of the liner is in alignment with the aperture of the sleeve and the handle receiving aperture of the paintbrush body.

11. The combination of claim 10, wherein the liner comprises absorbent material.

12. The combination of claim 9, further comprising a skirt operatively connected to the sleeve and movable between a first position where the skirt is substantially coextensive with the applicator of the brush, and a second position where the skirt is substantially coextensive with the handle of the brush.

13. A holder for a paintbrush of the type having a handle, a body, and an applicator, the holder comprising:

a sleeve having a plurality of sidewalls and a base with an aperture, the sleeve configured to substantially receive the body of a paintbrush in a nesting relation with the handle of the paintbrush protruding through the aligned aperture of the sleeve; and, a skirt comprising a first panel and a second panel, with the first and second panels operatively connected to the sleeve such that each panel may be moved independently of the other, the first and second panels constructed and arranged to be operatively connected to each other when the skirt is moved into a first position where the skirt is substantially coextensive with the applicator of a paintbrush, and a second position where the skirt is substantially coextensive with the handle of a paintbrush.

14. The holder of claim 13, wherein the first and second panels are hingedly connected to the sleeve.

15. The holder of claim 13, wherein the first and second panels are operatively connected along opposing sidewalls of the sleeve.

16. A holder for a paintbrush of the type having a handle, a body, and an applicator, the holder comprising:

a sleeve having a plurality of sidewalls and a base with an aperture, the sleeve configured to substantially receive the body of a paintbrush in a nesting relation with the handle of the paintbrush protruding through the aligned aperture of the sleeve; and, a skirt comprising a panel operatively connected to a segment of the sleeve, with the panel movable between a first position where the panel is substantially coextensive with the applicator of a paintbrush, and a second position where the panel is substantially coextensive with the handle of a paintbrush.

17. The holder of claim 16, wherein the segment of the sleeve to which the panel is operatively connected to is one of the plurality of sidewalls of the sleeve.

18. The holder of claim 17, wherein the panel is configured to be pivoted between the first and second positions.

* * * * *